US011414283B2

(12) United States Patent
Kawamura et al.

(10) Patent No.: US 11,414,283 B2
(45) Date of Patent: Aug. 16, 2022

(54) IMAGE FORMING APPARATUS, PRINTING SYSTEM, CONTROLLING METHOD OF IMAGE FORMING APPARATUS, AND STORAGE MEDIUM

(71) Applicant: CANON KABUSHIKI KAISHA, Tokyo (JP)

(72) Inventors: Nobuhiro Kawamura, Nagareyama (JP); Yuzo Harano, Sagamihara (JP); Hideaki Ooba, Yokohama (JP); Aya Ito, Tokyo (JP); Yusuke Kimura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 16/388,731

(22) Filed: Apr. 18, 2019

(65) Prior Publication Data

US 2019/0329995 A1 Oct. 31, 2019

(30) Foreign Application Priority Data

Apr. 25, 2018 (JP) ..... JP2018-083578

(51) Int. Cl.

| | |
|---|---|
| ***B65H 3/44*** | (2006.01) |
| ***B65H 1/26*** | (2006.01) |
| ***B65H 1/04*** | (2006.01) |
| ***G03G 15/00*** | (2006.01) |

(52) U.S. Cl.

CPC ..... *B65H 1/04* (2013.01); *G03G 15/5016* (2013.01); *G03G 15/6508* (2013.01); *B65H 2405/115* (2013.01); *B65H 2801/15* (2013.01)

(58) Field of Classification Search

CPC . B65H 3/44; B65H 1/04; B65H 1/266; B65H 2551/18; B65H 2405/115; B65H 2801/15; G03G 15/6508; G03G 15/502; G03G 15/5079; G03G 15/5016; G06K 15/4065; G06K 15/16; G06K 15/1823; G06F 3/1258; G06F 3/1254; G06F 3/1204; G06F 3/1285; G06F 3/1255

See application file for complete search history.

(56) References Cited

U.S. PATENT DOCUMENTS

| | | | | |
|---|---|---|---|---|
| 9,471,266 | B2 * | 10/2016 | Anno | G06F 3/1257 |
| 9,575,451 | B2 * | 2/2017 | Tsujita | G03G 15/502 |
| 2007/0040324 | A1 * | 2/2007 | Kim | B65H 1/26 271/162 |

(Continued)

FOREIGN PATENT DOCUMENTS

| | | | |
|---|---|---|---|
| JP | 06080274 | A * | 3/1994 |
| JP | 2005144927 | A * | 6/2005 |

(Continued)

*Primary Examiner* — Luis A Gonzalez

(74) *Attorney, Agent, or Firm* — Canon U.S.A., Inc. I.P. Division

(57) ABSTRACT

An image forming apparatus includes a sheet feeding device having a plurality of sheet feeding units, an opening and closing controlling unit, and a receiving unit. The opening and closing controlling unit controls opening and closing of the sheet feeding unit. Where the receiving unit receives an instruction for assigning a sheet having selected one attribute to designated one sheet feeding unit, the opening and closing controlling unit opens the designated one sheet feeding unit.

8 Claims, 14 Drawing Sheets

(56) References Cited

U.S. PATENT DOCUMENTS

| | | | | |
|---|---|---|---|---|
| 2013/0056922 | A1* | 3/2013 | Tsujita | B65H 7/20 271/9.05 |
| 2013/0321865 | A1* | 12/2013 | Hikichi | G06K 15/4065 358/1.15 |
| 2015/0062622 | A1* | 3/2015 | Ito | G06K 15/4065 358/1.15 |
| 2018/0314471 | A1* | 11/2018 | Yamakawa | G06F 3/1204 |

FOREIGN PATENT DOCUMENTS

| | | | | |
|---|---|---|---|---|
| JP | 2006088513 | A | * | 4/2006 |
| JP | 2009-006665 | A | | 1/2009 |
| JP | 2015223796 | A | | 12/2015 |
| JP | 2017053948 | A | * | 3/2017 |
| JP | 2017-064931 | A | | 4/2017 |

* cited by examiner

IMAGE FORMING APPARATUS, PRINTING SYSTEM, CONTROLLING METHOD OF IMAGE FORMING APPARATUS, AND STORAGE MEDIUM

BACKGROUND OF THE INVENTION

Field of the Invention

The present disclosure relates to an image forming apparatus which can assign sheets having various attributes to a plurality of sheet feeding units.

Description of the Related Art

In a production printing market, there is used a digital multifunction peripheral (hereinafter referred to as an image forming apparatus) which is equipped with various sheet feeding units including a plurality of sheet feeding decks, a manual feeding tray, an inserter and the like. Here, an operator sets an attribute of a sheet (paper) to be fed to each sheet feeding unit of the image forming apparatus, on an operation panel of the image forming apparatus, an operation unit of a print controlling apparatus connected to the image forming apparatus, and the like. Then, a sheet of which the attribute coincides with the set attribute is fed to the corresponding sheet feeding unit, so that printing is performed on the desired sheet. Here, the attribute of the sheet is discrimination information for discriminating the sheet. For example, the discrimination information is to discriminate a kind of sheet, a size, a basis weight, a surface property and the like. Besides, the attribute of the sheet may be displayed on a user interface screen.

As just described, in the image forming apparatus for production printing, since the attribute of the sheet to be fed can be set for each of the plurality of sheet feeding units, it is necessary to pay attention to coincide the attribute of the sheet set in each sheet feeding unit with the attribute of the sheet actually fed. When such sheet attributes do not coincide, a sheet jam occurs during printing and a deliverable is output with a sheet other than the desired sheet, so that productivity of an operator who uses the image forming apparatus is remarkably deteriorated.

For example, Japanese Patent Application Laid-Open No. 2015-223796 discloses a printing apparatus which, when there is a change in the size or the remaining amount of sheets fed to a sheet feeding deck in case of detecting opening and closing of the sheet feeding deck, displays a screen for urging an operator to set a kind of sheet. Thus, in Japanese Patent Application Laid-Open No. 2015-223796, it intends to prevent an error occurring when setting the kind of sheet to the sheet feeding deck.

The technique disclosed in Japanese Patent Application Laid-Open No. 2015-223796 is effective in case of opening the sheet feeding deck and feeding the sheet prior to the setting of the kind of sheet in the sheet feeding deck. However, when the kind of sheet is first set in the sheet feeding deck, it is not possible to prevent an error in the sheet feeding to the sheet feeding deck.

SUMMARY OF THE INVENTION

The disclosed image forming apparatus works towards ensuring that a sheet of which the attribute coincides with an attribute of a sheet set in each sheet feeding unit is assuredly fed.

According to an aspect of the present disclosure, an image forming apparatus includes a sheet feeding device having a plurality of sheet feeding units, an opening and closing controlling unit, and a receiving unit. The opening and closing controlling unit controls opening and closing of the sheet feeding unit. Where the receiving unit receives an instruction for assigning a sheet having selected one attribute to designated one sheet feeding unit, the opening and closing controlling unit opens the designated one sheet feeding unit.

The present disclosure is characterized by an image forming apparatus comprising: a sheet feeding device comprising a plurality of sheet feeding units; an opening and closing controlling unit configured to control opening and closing of the sheet feeding unit; and a receiving unit, wherein, when the receiving unit receives an instruction for assigning a sheet having selected one attribute to designated one sheet feeding unit, the opening and closing controlling unit is configured to open the designated one sheet feeding unit.

Further features of the present disclosure will become apparent from the following description of embodiments with reference to the attached drawings.

DESCRIPTION OF THE EMBODIMENTS

Hereinafter, embodiments of the present disclosure will be described with reference to the attached drawings.

Embodiment 1

Figure 1:
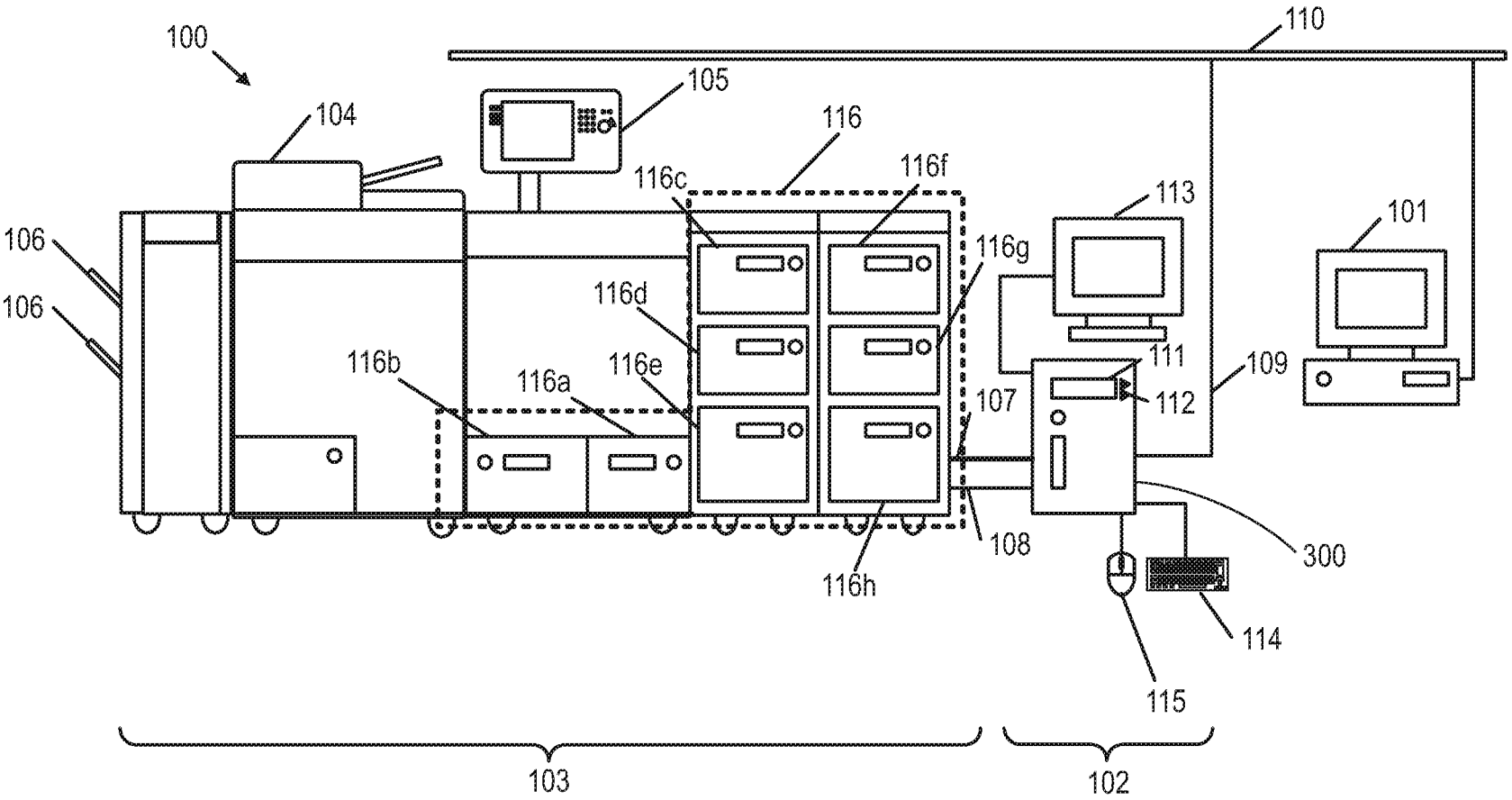
FIG. 1 is a diagram for describing an overall configuration of a printing system.

FIG. 1 is a diagram for describing an overall configuration of a printing system 100.

The printing system 100 is equipped with an image forming apparatus 103 and a print controlling apparatus 102. The printing system 100 is communicably connected to a client computer 101.

The client computer 101 and the print controlling apparatus 102 are communicably connected to each other via an Ethemet™ cable 109 and a LAN (local area network) 110. Besides, the print controlling apparatus 102 and the image forming apparatus 103 are connected to each other via an image video cable (LAN) 107 and a control cable 108. Incidentally, a LAN cable is used as the control cable 108, and the control cable 108 is sometimes referred to as a LAN 108 in the following.

Incidentally, in the printing system 100 illustrated in FIG. 1, the image forming apparatus 103 is not directly connected to the LAN 110. The image forming apparatus 103 and the client computer 101 communicate with each other via the print controlling apparatus 102.

However, the image forming apparatus 103 may be connected to the LAN 110. That is, the image forming apparatus 103 may be directly connected communicably to the client computer 101.

The client computer 101 starts an application by an operation of an operator, and issues a print instruction and the like to the printing system 100.

The print controlling apparatus 102 performs an image process in cooperation with the image forming apparatus 103.

The image forming apparatus 103 is a multifunction peripheral having various functions. The image forming apparatus 103 performs the image processes instructed from the client computer 101 and the print controlling apparatus 102, and can also copy data read from a scanner unit 104 or transmit the read data to a shared folder.

In order to scan an image by the scanner unit 104, an operation unit (operation panel) 105 accepts various instructions from the operator via various keys. Besides, the operation unit 105 displays various kinds of information related to the image forming apparatus 103, such as a scanning state and the like, via the panel.

Each of sheet discharging units 106 receives a sheet on which an image has been formed and discharges the received sheet.

The print controlling apparatus 102 is equipped with a controller unit 300.

A display unit 111 of the print controlling apparatus 102 displays information related to the print controlling apparatus 102.

An operation button unit 112 of the print controlling apparatus 102 operates, by being depressed by an operator, the information displayed on the display unit 111. On the display unit 111, information (for example, for power supply operation, confirmation of IP address or the like) minimally necessary in operating the print controlling apparatus 102 is displayed.

A display device 113 of the print controlling apparatus 102 is a display unit having a liquid crystal monitor or the like. The display unit displays the information related to the image forming apparatus 103 via the LAN 108.

Here, operation units such as a keyboard 114, a mouse 115 and the like are connected to the print controlling apparatus 102. Information for operating the image forming apparatus 103 is input from the operation unit via the LAN 108. Incidentally, instead of the mouse, another pointing device may be used.

In the printing system 100 of the present embodiment, the print controlling apparatus 102 and the image forming apparatus 103 are respectively constituted as separate apparatuses. However, the functions of the print controlling apparatus 102, including the display device 113, may be included in the image forming apparatus 103 without physically arranging the print controlling apparatus 102.

Besides, the display device 113 may have a position input function such as a touch pad or the like, and may also have a function as the operation unit such as the mouse 115.

Incidentally, sheet feeding units 116*a* to 116*h* (hereinafter collectively referred to as "a sheet feeding unit 116" in some cases) are devices for storing sheets to be used for printing. When a print instruction is received, any one of the sheet feeding units 116*a* to 116*h* is selected, and the sheet is fed from the selected sheet feeding unit. Incidentally, depending on an optional constitution connected to the image forming apparatus 103, the number of the sheet feeding units 116 may be increased or decreased.

Incidentally, in the example illustrated in FIG. 1, the sheet feeding unit 116 is a sheet feeding deck. However, the sheet feeding deck is an example of the sheet feeding unit, and another sheet feeding unit such as an inserter, a manual feeding tray or the like may be used. Namely, the form of the sheet feeding unit is not limited.

Figure 2:
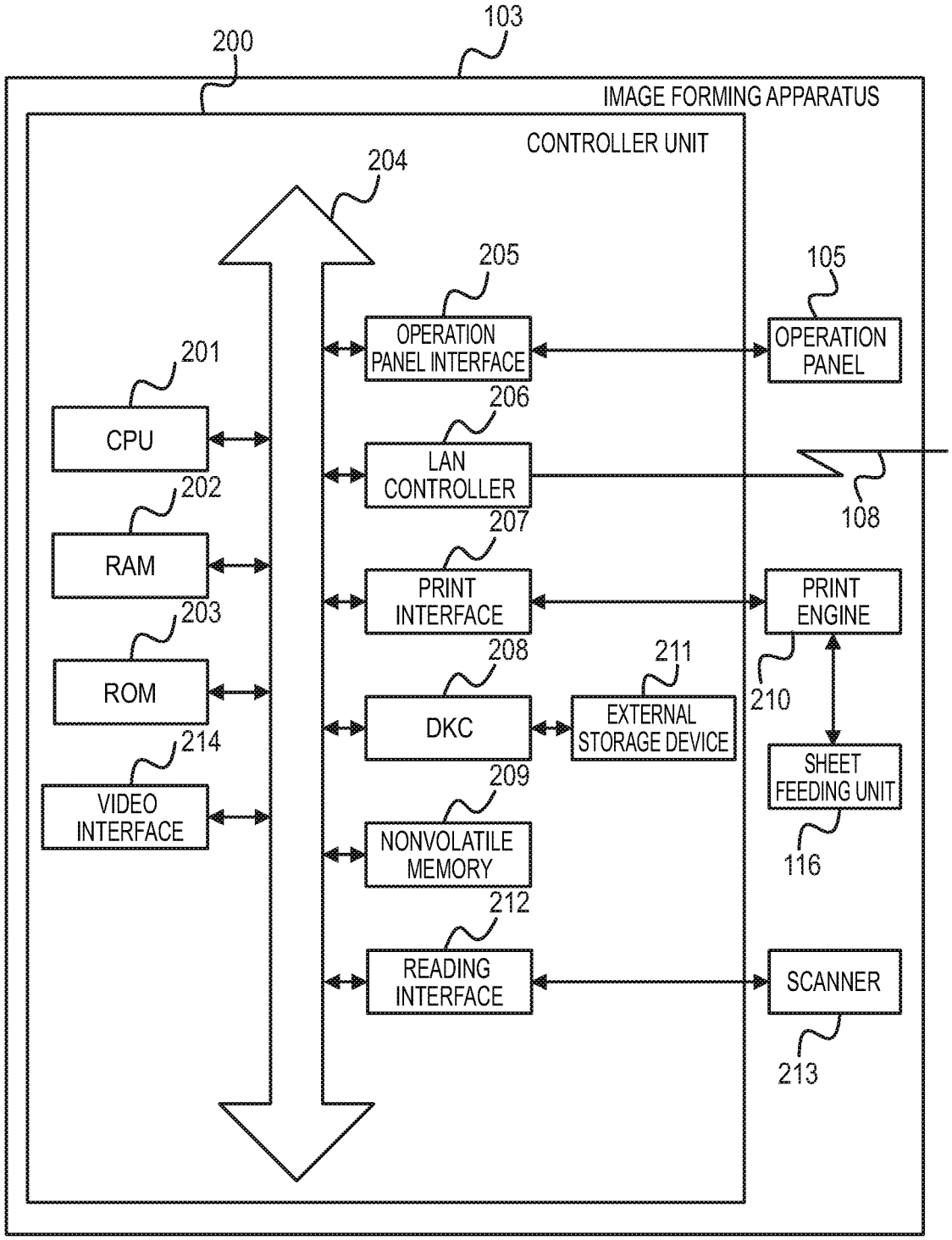
FIG. 2 is a block diagram for describing a hardware constitution of an image forming apparatus.

FIG. 2 is a block diagram for describing a hardware constitution of the image forming apparatus 103.

The image forming apparatus 103 is equipped with a controller unit 200.

Hereinafter, various devices provided in the controller unit 200 will be described.

A CPU (central processing unit) 201 comprehensively controls access to various devices connected to a system bus 204, based on a control program stored in a ROM (read only memory) 203 or an external storage device 211.

The CPU 201 outputs an image signal as output information to a print engine 210 (printing unit) connected via a print interface 207. Besides, the CPU 201 controls an image signal input from a scanner 213 (reading unit) connected via a reading interface 212.

Besides, via the print interface 207, the CPU 201 controls the sheet feeding unit 116 connected to the print engine 210 and obtains a state of the sheet feeding unit 116.

Incidentally, the CPU 201 can communicate with the print controlling apparatus 102 via a LAN controller 206 and the LAN 108.

A RAM (random access memory) 202 mainly functions as a main memory, a working area and the like of the CPU 201.

The external storage device 211 is constituted by an HDD (hard disk drive), an IC (integrated circuit) card or the like, and access thereto is controlled by a DKC (disk controller) 208.

The external storage device 211 is used as a job storage area for storing an application program, font data, form data and the like, temporarily spooling a print job, and controlling the spooled job from the outside. Further, the external storage device 211 holds various logs such as a job log, an image log and the like. Besides, the external storage device 211 holds image data read by the scanner 213 and image data of the print job as BOX data. In this case, the external storage device functions as a BOX data storage area used for reference, printing and the like from a network.

In the present embodiment, an HDD is used as the external storage device 211.

An operation panel interface 205 is an interface which is used for an operator to input various kinds of information from a software key or a hardware key on the operation panel 105.

A nonvolatile memory 209 is used to store various kinds of setting information set from a terminal via the operation panel 105 and the network.

A video interface 214 receives image data from the print controlling apparatus 102.

Figure 3:
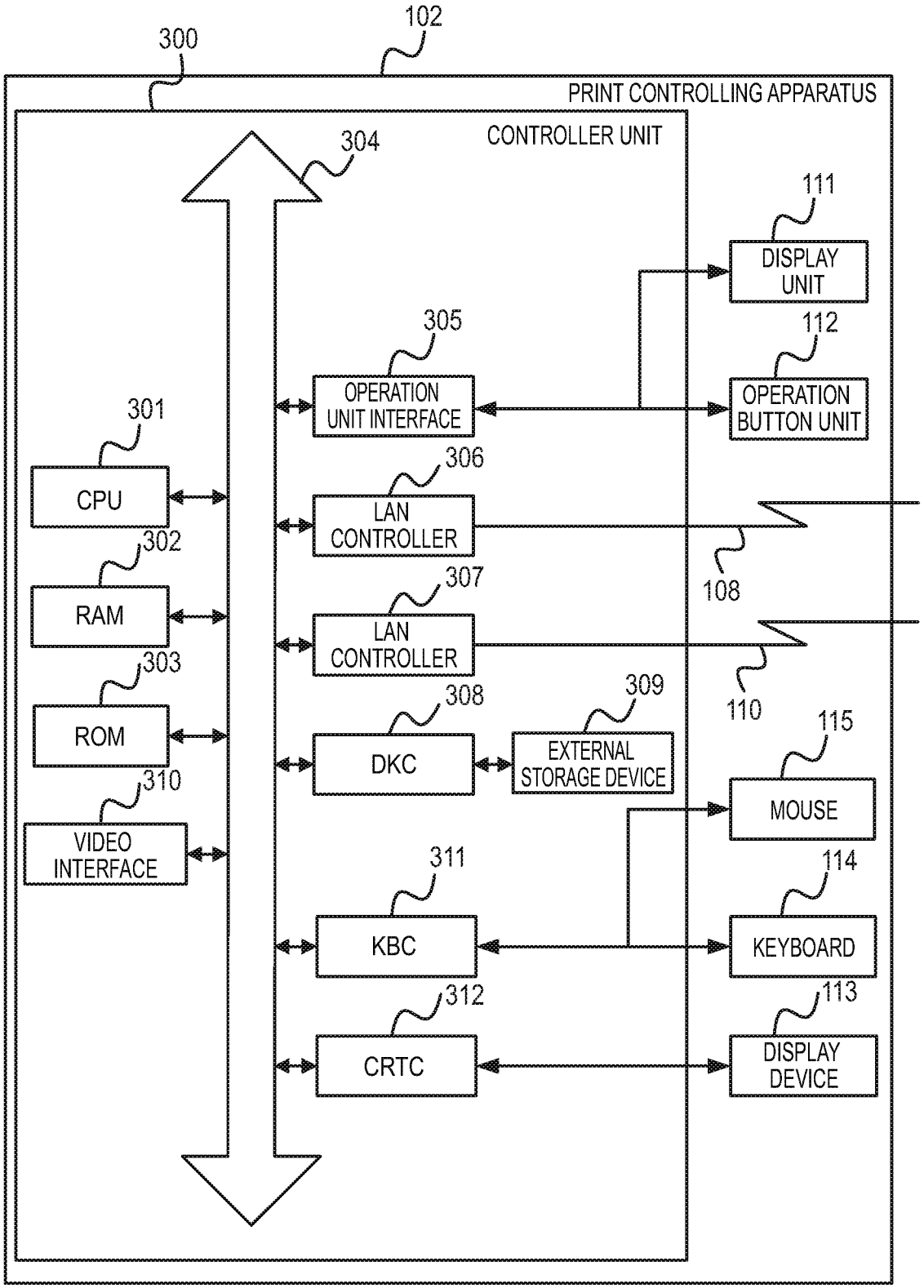
FIG. 3 is a block diagram for describing a hardware constitution of a print controlling apparatus.

FIG. 3 is a block diagram for describing a hardware constitution of the print controlling apparatus 102.

The print controlling apparatus 102 is equipped with a controller unit 300.

Hereinafter, various devices provided in the controller unit 300 will be described.

A CPU 301 comprehensively controls access to various devices connected to a system bus 304, based on a control program stored in a ROM 303 or an external storage device 309.

Besides, the CPU 301 can perform a communication process with the image forming apparatus 103 via a LAN controller 306 and the LAN 108. Besides, the CPU 301 can communicate with the client computer 101 and the image forming apparatus 103 on the network via a LAN controller 307 and the LAN 110.

A RAM 302 mainly functions as a main memory, a working area and the like of the CPU 301.

The external storage device 309 is constituted by an HDD, an IC card or the like, and access thereto is controlled by a DKC 308.

The external storage device 309, which is a hard disk here, is used to store an application program, font data, form data and the like, and spool a print job temporarily. Besides, the external storage device 309 is used as a job storage area for performing an RIP (raster image processor) process and again storing the spooled job.

An operation unit interface 305 is an interface to be used when the operator inputs various kinds of information from the operation button unit 112. Besides, the operation unit interface 305 is also an interface for displaying information on the display unit 111. Incidentally, the information input by the operator is displayed on the display unit 111.

A video interface 310 is used to transmit an RIP-processed image data to the image forming apparatus 103.

A KBC (keyboard controller) 311 processes information input from the keyboard 114, the mouse 115 and the like.

A display controlling unit (CRTC (cathode ray tube controller)) 312, which includes a video memory therein, performs drawing in the video memory according to an instruction from the CPU 301, and outputs an image data corresponding to the drawing in the video memory to the display device 113 as a video signal.

Figure 4A:
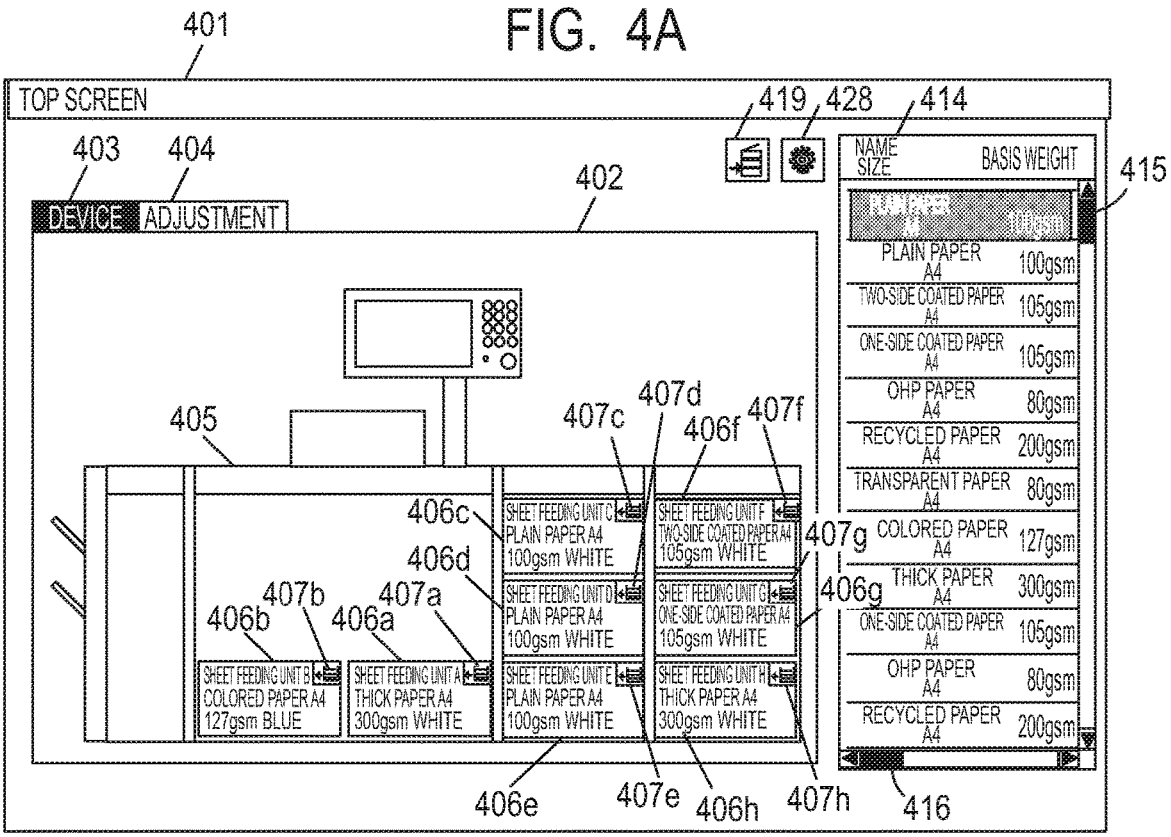
FIGS. 4A and 4B are examples of a top screen of a sheet management application.
Figure 4B:
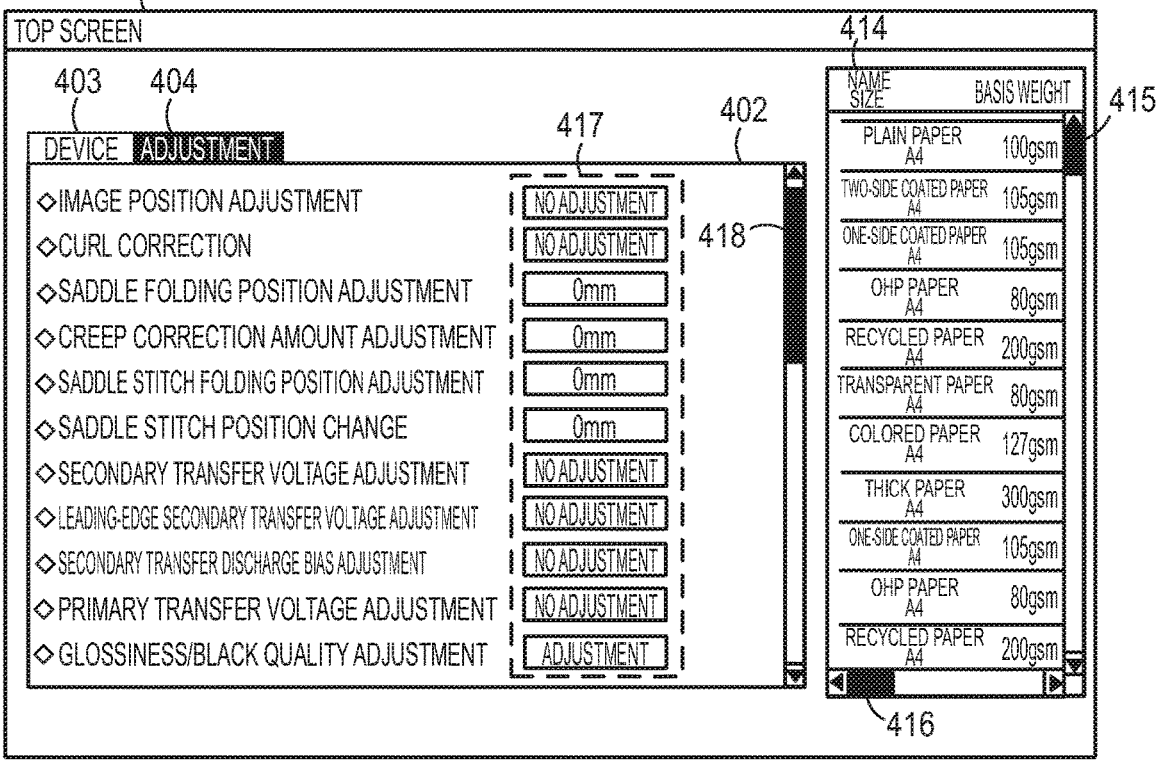

FIGS. 4A and 4B are examples of a top screen displayed on the display device 113 of the print controlling apparatus 102 when a sheet management application is started.

The sheet management application is application software by which an operator checks an attribute of a sheet set in each of the sheet feeding units 116*a* to 116*h* and the operator sets sheet attribute information for each sheet feeding unit. The sheet management application operates on the print controlling apparatus 102.

FIG. 4A is a display example of a top screen 401 on which information such as the sheet attributes set in the sheet feeding units 116*a* to 116*h* of the image forming apparatus 103 is displayed.

FIG. 4B is a display example of the top screen 401 on which adjustment buttons 417 for performing various adjustments of the image forming apparatus 103 are displayed.

The image data displayed on the top screen 401 of the sheet management application is drawn in the video memory in accordance with an instruction from the CPU 301. The image data drawn in the video memory is output to the display device 113 as a video signal, and then displayed.

Subsequently, contents to be displayed on the top screen 401 of the sheet management application will be described.

Various buttons displayed in a display area 402 can be selected by tab control.

When the operator depresses a device tab 403, the screen showing the information related to the sheet feeding units 116*a* to 116*h* of the image forming apparatus 103 is displayed in the display area 402 (see FIG. 4A).

When the operator depresses an adjustment tab 404, the screen showing the adjustment buttons 417 for setting various parameters of the image forming apparatus 103 is displayed in the display area 402 (see FIG. 4B).

In the top screen 401 illustrated in FIG. 4A, a hardware option connection situation chart 405 represents the hardware option of the image forming apparatus 103 being connected to the print controlling apparatus 102. When the sheet management application is started, the CPU 301 obtains information related to the connection situation of the hardware option of the image forming apparatus 103, and displays the obtained information as the hardware option connection situation chart 405 on the display unit 113. Incidentally, the hardware option is hardware components such as the sheet feeding units 116*a* to 116*h* which are detachably connected as options to the image forming apparatus 103.

In the example illustrated in FIG. 4A, a state in which the sheet discharging unit and sheet feeding units A to H are connected to others is shown. Here, the sheet feeding units A to H illustrated in FIG. 4A respectively correspond to the sheet feeding units 116*a* to 116*h* of the image forming apparatus 103 illustrated in FIG. 1.

Sheet feeding unit buttons 406*a* to 406*h* are created based on the information related to the connection situation of the sheet feeding unit 116 of the image forming apparatus 103 obtained by the CPU 301 when the sheet management application is started, and these buttons are arranged in the hardware option connection situation chart 405.

A sheet list field 414 is a field for displaying attributes of various kinds of sheets (papers). In the sheet list field 414, information related to the attribute of the sheet is displayed for each row. By operating slider bars 415 and 416, it is possible to also display the information related to the attribute of the sheet which is not currently displayed.

A sheet assignment button 419 is a button for assigning sheets to be fed to the sheet feeding units 116*a* to 116*h*.

The operator depresses the sheet assignment button 419 in a state that a desired one is selected from the attributes of the sheets displayed in the sheet list field 414. Thus, the sheet feeding unit buttons 406*a* to 406*h* corresponding to the one or more sheet feeding units 116*a* to 116*h* to which the sheet of the selected attribute can be set are changed from normal display to highlight display. Then, by clicking a desired one sheet feeding unit from among the highlight-displayed sheet feeding units, the operator can assign the selected sheet to the designated sheet feeding unit.

The CPU 301 decides whether or not the target sheet feeding unit is the sheet feeding unit to which the selected sheet can be set, based on the information obtained from the image forming apparatus 103.

As the method of assigning the sheet, in addition to the method of clicking any one of the sheet feeding unit buttons 406*a* to 406*h*, there may be a method of selecting a desired one sheet from the sheet list field 414, dragging the selected sheet, and dropping the dragged sheet onto any one of the sheet feeding unit buttons 406*a* to 406*h*. Also in this case, only the sheet feeding unit to which the sheet of the selected attribute can be assigned is highlighted.

Besides, as will be described later with reference to FIG. 9, the sheet may be assigned by selecting any one sheet feeding unit from the list of the sheet feeding units displayed when right-clicking is performed in a state that any arbitrary one of the sheets displayed in the sheet list field 414 is selected.

Sheet feeding unit open buttons 407*a* to 407*h* are buttons for physically opening the corresponding sheet feeding units.

When the operator depresses any one of the sheet feeding unit open buttons 407*a* to 407*h*, an open instruction for opening the one of the sheet feeding units 116*a* to 116*h* corresponding to the depressed button is transmitted to the image forming device 103 via the LAN 107. When the open instruction is received, the image forming apparatus 103 physically opens the target sheet feeding unit. Incidentally, the sheet feeding unit open buttons 407*a* to 407*h* are displayed only in the sheet feeding unit which can remotely receive the open instruction.

A setting button 428 is a button for opening a screen to be used for performing various settings of the sheet management application. When the setting button 428 is depressed, the top screen 401 illustrated in FIG. 4B is opened. Thus, the operator can perform various settings on the opened screen.

On the top screen 401 illustrated in FIG. 4B, respective items in the adjustment buttons 417 indicate various parameters that can be adjusted via the adjustment buttons 417 for the image forming apparatus 103. Here, it should be noted that parameters not currently displayed can be displayed by operating a slider bar 418.

Figure 5:
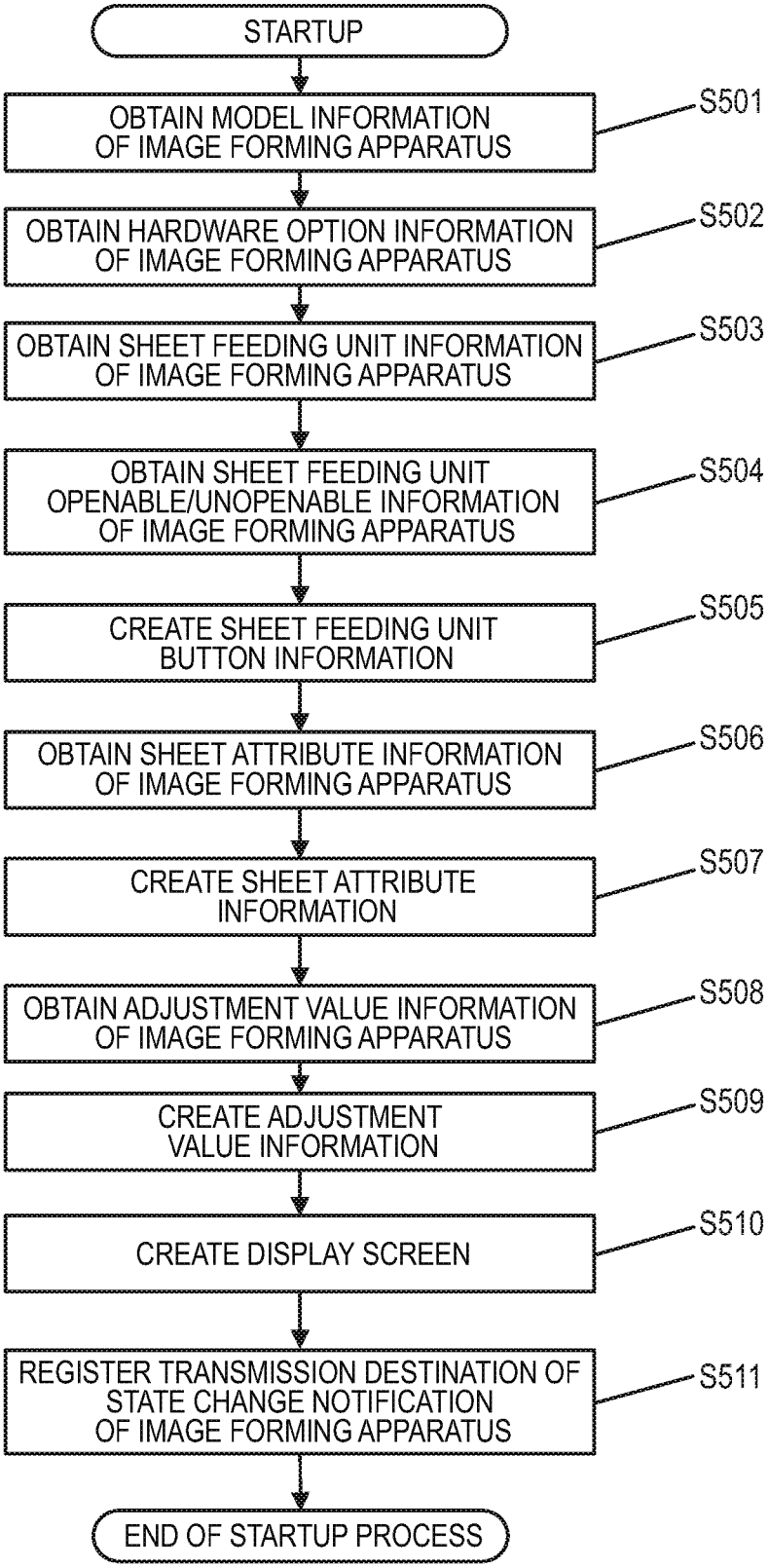
FIG. 5 is a flowchart for describing a process to be performed at a time of startup of the print controlling apparatus.

FIG. 5 is a flowchart for describing a process to be performed by the print controlling apparatus 102 when the top screen 401 of the sheet management application is created after the startup of the sheet management application.

Figure 6:
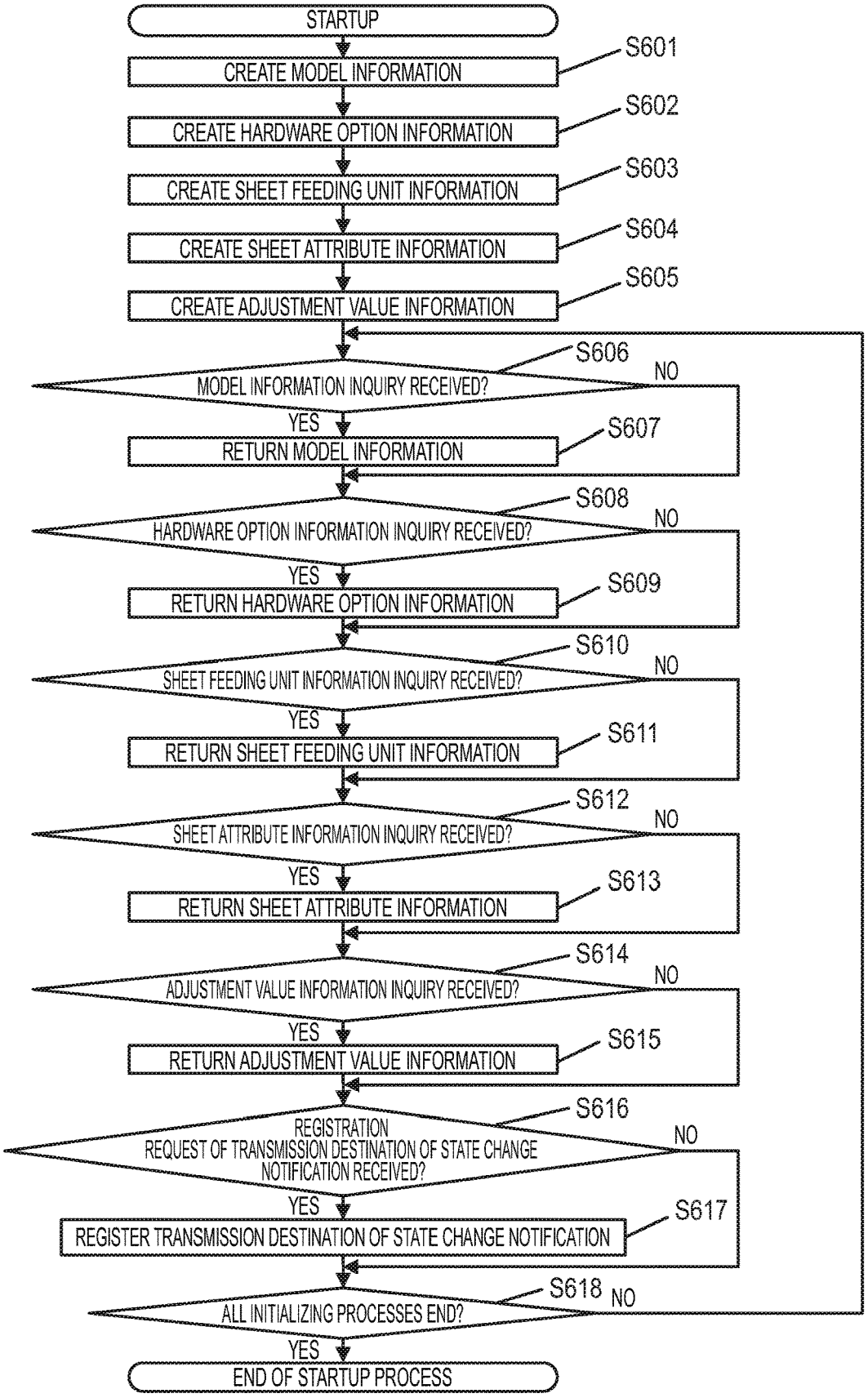
FIG. 6 is a flowchart for describing a process to be performed at a time of startup of the image forming apparatus.

FIG. 6 is a flowchart for describing a process in which, after the startup, the image forming apparatus 103 creates information to be shared with the print controlling apparatus 102 by communicating with the sheet management application.

First, the flowchart of FIG. 5 will be described.

The program for performing the process of the flowchart in FIG. 5 is stored in the external storage device (HDD) 309 of the print controlling apparatus 102 illustrated in FIG. 3, read into the RAM 302, and executed by the CPU 301.

When the sheet management application is started, in S501, the sheet management application discriminates a model of the image forming apparatus 103 for which sheet management should be performed, thereby obtaining model information of the image forming apparatus.

The sheet management application communicates with the image forming apparatus 103, and obtains information (model information) related to the model from information returned in S607 (described later). Then, based on model discrimination information previously held by the sheet management application, the sheet management application discriminates the model of the image forming apparatus 103 from the obtained information related to the model.

The sheet management application uses the discrimination result of the model of the image forming apparatus 103, when creating the hardware option connection situation chart 405 illustrated in FIG. 4A or when absorbing a specification difference for each model.

When the model of the image forming apparatus 103 is discriminated in S501, the process proceeds to S502.

In S502, the sheet management application communicates with the image forming apparatus 103, and obtains information (hardware option information) related to the hardware option from information returned in S609 (described later). Then, the sheet management application discriminates the hardware option connected to the image forming apparatus 103.

When creating the hardware option connection situation chart 405, when identifying the information of the sheet feeding unit 116, and when absorbing the specification difference of each model, the sheet management application uses the discrimination result of the hardware option.

When the information related to the hardware option is obtained by communicating with the image forming apparatus, the process proceeds to S503.

In S503, the sheet management application communicates with the image forming apparatus 103, and obtains information (sheet feeding unit information) related to the sheet feeding unit of the image forming apparatus 103 from information returned in S611 (described later).

The information related to the sheet feeding unit includes information related to the constitutions of the sheet feeding unit 116 such as an option deck, a manual feeding tray, a long sheet feeding tray and the like, and information related to the sheet attributes set in the sheet feeding units 116*a* to 116*h*. Besides, the sheet management application discriminates the sheet feeding unit connected to the image forming apparatus 103 for which the sheet management should be performed, and identifies the number of the sheet feeding units connected.

When the information related to the sheet feeding unit is obtained in S503, the process proceeds to S504.

In S504, the sheet management application communicates with the image forming apparatus 103. Then, by the depression of the sheet feeding unit open buttons 407*a* to 407*h*, the sheet management application obtains information (sheet feeding unit openable/unopenable information) as to whether or not the corresponding sheet feeding units 116*a* to 116*h* can be opened, from the information returned in S611 (described later).

When the information related to the opening and closing of the sheet feeding unit is obtained in S504, the process proceeds to S505.

In S505, the sheet management application creates information (sheet feeding unit button information) related to the sheet feeding unit displayed in the hardware option connection situation chart 405.

The information related to the sheet feeding unit displayed in the hardware option connection situation chart 405 includes the information related to the sheet feeding unit buttons 406*a* to 406*h* obtained in S503 and the information related to the sheet feeding unit open buttons 407*a* to 407*h* obtained in S504.

The information related to the sheet feeding unit buttons 406*a* to 406*h* is created based on the information related to the sheet attributes set in the sheet feeding units 116*a* to 116*h* obtained in S503. Besides, the information related to the sheet feeding unit open buttons 407*a* to 407*h* is created based on the information obtained in S504 as to whether or not each of the sheet feeding units 116*a* to 116*h* can be opened.

When the information related to the sheet feeding unit displayed in the hardware option connection situation chart 405 is created in S505, the process proceeds to S506.

In S506, the sheet management application communicates with the image forming apparatus 103, and obtains information (sheet attribute information) related to the attribute of the sheet returned in S613 (described later).

Here, the information related to the attribute of the sheet is information related to the attribute of the sheet which can be set in the image forming apparatus 103, and is information related to kinds of sheets (plain paper, transparent paper, and the like), sizes, basis weights and the like.

When the information related to the attribute of the sheet is obtained in S506, the process proceeds to S507.

In S507, the sheet management application creates the information (sheet attribute information) related to the attributes of the sheets to be displayed in the sheet list field 414.

Here, the information related to the attribute of each sheet to be displayed in the sheet list field 414 also includes information as to whether or not to be able to feed the relevant sheet to each of the sheet feeding units 116*a* to 116*h* of the image forming apparatus 103.

When the information related to the attributes of the sheets to be displayed in the sheet list field 414 is created in S507, the process proceeds to S508.

In S508, the sheet management application communicates with the image forming apparatus 103, and obtains information (adjustment value information) related to adjustment values of various parameters concerning the image forming apparatus 103 from information returned in S615 (described later).

When the adjustment values are obtained in S508, the process proceeds to S509.

In S509, the sheet management application creates the contents of various parameters for the image forming apparatus 103 to be displayed on the adjustment buttons 417, based on the information obtained in S508. Namely, the sheet management application creates the adjustment value information.

More specifically, in a case where there is only one adjustment value, "ADJUSTMENT" or "NO ADJUSTMENT" is displayed. In a case where there are two or more adjustment values, the actual adjustment value is displayed.

When the adjustment buttons 417 are created in S509, the process proceeds to S510.

In S510, the sheet management application creates the screen (see FIG. 4A) to be displayed in the display area 402 from the information related to the sheet feeding unit created in S505.

Besides, the sheet management application creates the screen to be displayed in the sheet list field 414 from the information related to the attributes of the sheets created in S507.

Besides, the sheet management application creates the screen (see FIG. 4B) to be displayed in the field of the adjustment buttons 417 of the display area 402 from the information related to the various parameters created in S509.

When the screen is created in S510, the process proceeds to S511.

In S511, the sheet management application registers the print controlling apparatus 102 as a transmission destination of a state change notification to be notified when the information related to the sheet feeding unit of the image forming apparatus 103, the information related to the attribute of the sheet attribute, and the like are changed.

When the registration is successful, a waiting process of waiting for the state change notification is performed. When the waiting process of state change notification is performed, the process illustrated in FIG. 5 ends.

It should be noted that the flowchart illustrated in FIG. 5 has been described as the process to be performed at the time of the startup of the sheet management application. However, the information related to the sheet feeding unit 116 of the image forming apparatus 103, the information related to the attribute of the sheet, and the adjustment values of the various parameters of the image forming apparatus 103 may be changed at any time even during the use of the sheet management application.

Therefore, when any one of these pieces of information is updated, communication is performed at any time between the print controlling apparatus 102 and the image forming apparatus 103, if necessary. Then, each piece of information may always be shared between the print controlling apparatus 102 and the image forming apparatus 103.

Next, the flowchart of Fla 6 will be described.

The program for performing the process of the flowchart in FIG. 6 is stored in the HDD (external storage device) 211 of the image forming apparatus 103 illustrated in FIG. 2, read into the RAM 202, and executed by the CPU 201.

When the image forming apparatus 103 is started, in S601, the image forming apparatus 103 obtains the information related to its own model from the HDD 211, and creates the information (model information) as returnable data.

When the information related to the model is created in S601, the process proceeds to S602.

In S602, the image forming apparatus 103 obtains the information related to the hardware option connected to the own apparatus from the HDD 211, and creates the information (hardware option information) as returnable data.

When the information related to the connected hardware option is created in S602, the process proceeds to S603.

In S603, the image forming apparatus 103 obtains the information related to its own sheet feeding unit from the HDD 211, and creates the information (sheet feeding unit information) as returnable data.

When the information related to the sheet feeding unit is created in S603, the process proceeds to S604.

In S604, the image forming apparatus 103 obtains the information related to the attribute of the sheet set in its own sheet feeding unit from the HDD 211, and creates the information (sheet attribute information) as returnable data.

When the information related to the attribute of the sheet is created in S604, the process proceeds to S605.

In S605, the image forming apparatus 103 obtains the information related to the adjustment values of the various parameters of the own apparatus from the HDD 211, and creates the information (adjustment value information) as returnable data.

The information related to the adjustment value is obtained for all the parameters that can be adjusted in the image forming apparatus 103.

When the information related to the adjustment values is created in S605, the process proceeds to S606.

In S606, the image forming apparatus 103 decides whether or not an inquiry about the information related to the model (model information inquiry) is received from the print controlling apparatus 102.

When the inquiry about the information related to the model is made in S501 of the startup flow of the sheet management application, the process proceeds to S607. Then, the information related to the model created in S601 is returned to the print controlling apparatus 102, and the process proceeds to S608.

When the inquiry about the information related to the model is not received in S606, the process directly proceeds to S608.

In S608, the image forming apparatus 103 decides whether or not an inquiry about the information related to the connected hardware option (hardware option information inquiry) is received from the print controlling apparatus 102.

When the inquiry about the information related to the hardware option is made in S502 of the startup flow of the sheet management application, the process proceeds to S609. Then, the information related to the hardware option created in S602 is returned to the print controlling apparatus 102, and the process proceeds to S610.

When the inquiry about the information related to the hardware option is not received in S608, the process directly proceeds to S610.

In S610, the image forming apparatus 103 decides whether or not an inquiry about the information related to the sheet feeding unit (sheet feeding unit information inquiry) is received from the print controlling apparatus 102.

When the inquiry about the information related to the sheet feeding unit is made in S503 or S504 of the startup flow of the sheet management application, the process proceeds to S611. Then, the image forming apparatus 103 returns the information related to the sheet feeding unit created in S603 to the print controlling apparatus 102, and the process proceeds to S612.

When the inquiry about the information related to the sheet feeding unit is not received in S610, the process directly proceeds to S612.

In S612, the image forming apparatus 103 decides whether or not an inquiry about the information related to the attribute of the sheet set in the sheet feeding unit (sheet attribute information inquiry) is received from the print controlling apparatus 102.

When the inquiry about the information related to the attribute of the sheet is made in S506 of the startup flow of the sheet management application, the process proceeds to S613. Then, the image forming apparatus 103 returns the information related to the attribute of the sheet created in S604 to the print controlling apparatus 102, and the process proceeds to S614.

When the inquiry about the information related to the attribute of the sheet is not received in S612, the process directly proceeds to S614.

In S614, the image forming apparatus 103 decides whether or not an inquiry about the information related to the adjustment values of the various parameters (adjustment value information inquiry) is received from the print controlling apparatus 102.

When the inquiry about the information related to the adjustment value is made in S508 of the startup flow of the sheet management application, the process proceeds to S615. Then, the image forming apparatus 103 returns the information related to the adjustment value to the print controlling apparatus 102, and the process proceeds to S616.

When the inquiry about the information related to the adjustment value is not received in S614, the process directly proceeds to S616.

In S616, when the information related to the sheet feeding unit, the information related to the attribute of the sheet, or the like is changed, the image forming apparatus 103 decides whether or not a request for registration of transmission destination information at the time of transmitting the state change notification is received from the print controlling apparatus 102.

When the request for the registration of the transmission destination (information) of the state change notification is made in S511 of the startup flow of the sheet management application, the process proceeds to S617. Then, the image forming apparatus 103 adds the print controlling apparatus 102 as the transmission destination of the state change notification, and the process proceeds to S618.

When the registration request of the transmission destination of the state change notification is not received in S616, the process directly proceeds to S618.

In S618, the image forming apparatus 103 decides whether or not the processes in S606, S608, S610, S612, S614 and S616 are all successful.

When all the processes are successful, the process in the flow chart of FIG. 6 ends.

On the other hand, when there is the process which is not yet successful, the process returns to S606.

Here, the explanation is returned to FIGS. 4A and 4B.

When the sheet feeding unit button 406*a* is depressed with the mouse 115 or the like, since the screen (see FIG. 4B) for setting the sheet in the sheet feeding unit A is displayed, it becomes possible to set the sheet in the sheet feeding unit A, change the set value of the set sheet, and the like. Since the other sheet feeding unit open buttons 407*b* to 407*h* are also the same as the sheet feeding unit button 406*a*, the descriptions of the operations and functions thereof will be omitted.

Although it is not described in detail here, the sheet feeding unit may include all kinds of sheet feeding units such as an inserter, a manual feeding tray and the like. Besides, in the following description, the descriptions of the operation of the operator such as using the mouse 115 at the time of operating the application such as the depression of the button and the like will be omitted. However, the operator may perform the operations by using suchlike input devices.

Next, an opening and closing controlling mechanism of controlling opening and closing of the sheet feeding unit 116 will be described unit with reference to the diagrams of FIGS. 7A and 7B.

Figure 7A:
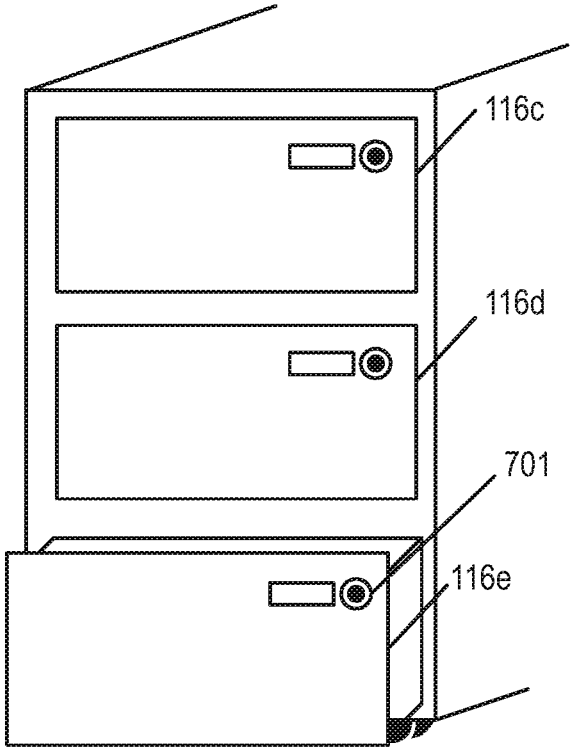
FIGS. 7A and 7B are diagrams for describing a mechanism of opening and closing a sheet feeding unit.
Figure 7B:
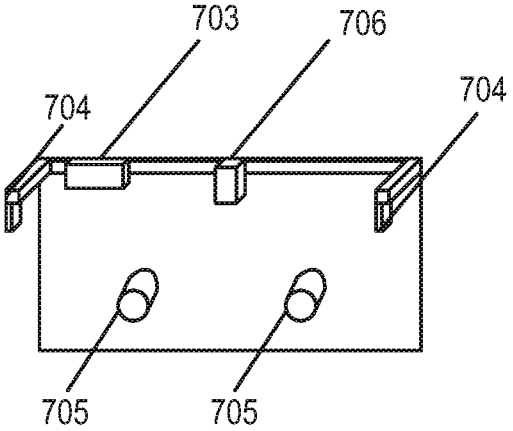

More specifically, FIG. 7A is the diagram for describing a state that a sheet feeding unit open button 701 in the lower stage of the sheet feeding unit 116 is depressed and thus the sheet feeding unit 116*e* is physically opened. Besides, FIG. 7B is the diagram of the front cover portion of the sheet feeding unit 116 as viewed from the back side.

When the sheet feeding unit open button 701 is depressed, a solenoid 703 which controls the opening and the closing of the sheet feeding unit 116*e* operates. Then, sheet feeding unit locks 704 are unlocked, and the sheet feeding unit 116*e* is in an open state. Thus, the sheet feeding unit 116*e* can be physically drawn out.

In this state, due to spring force of springs 705, the front face of the sheet feeding unit 116*e* is pushed forward a few centimeters. Besides, when the sheet feeding unit 116*e* is in the open state, the open state of the sheet feeding unit 116*e* is detected by a sheet feeding unit lock detection sensor 706, and the open state is notified to the RAM 202 via the print engine 210.

Besides, when the operator physically pushes the front face of the sheet feeding unit 116, the sheet feeding unit 116*e* is closed.

When the sheet feeding unit 116*e* is closed, the sheet feeding unit lock detection sensor 706 detects that the sheet feeding unit is closed, and notifies the RAM 202 of a close state of the sheet feeding unit 116*e* via the print engine 210. Besides, the closing of the sheet feeding unit 116*e* is notified to the transmission destination registered as the transmission destination to which the state change of the sheet feeding unit of the image forming apparatus 103 is to be notified. When the print controlling apparatus 102 is registered in S617, the state change notification is also transmitted to the print controlling apparatus 102.

In addition to the depression of the sheet feeding unit open button 701, it is possible to open the sheet feeding unit 116*e* by depressing the sheet feeding unit open button 407*e* disposed in the sheet management application.

When each of the sheet feeding unit open buttons 407*a* to 407*h* is depressed, the open instruction to open each of the sheet feeding units 116*a* to 116*h* corresponding to the depressed button is transmitted to the image forming apparatus 103 via the LAN 107. When the open instruction to open the sheet feeding unit is received, the image forming apparatus 103 physically opens the target sheet feeding unit.

Figure 8:
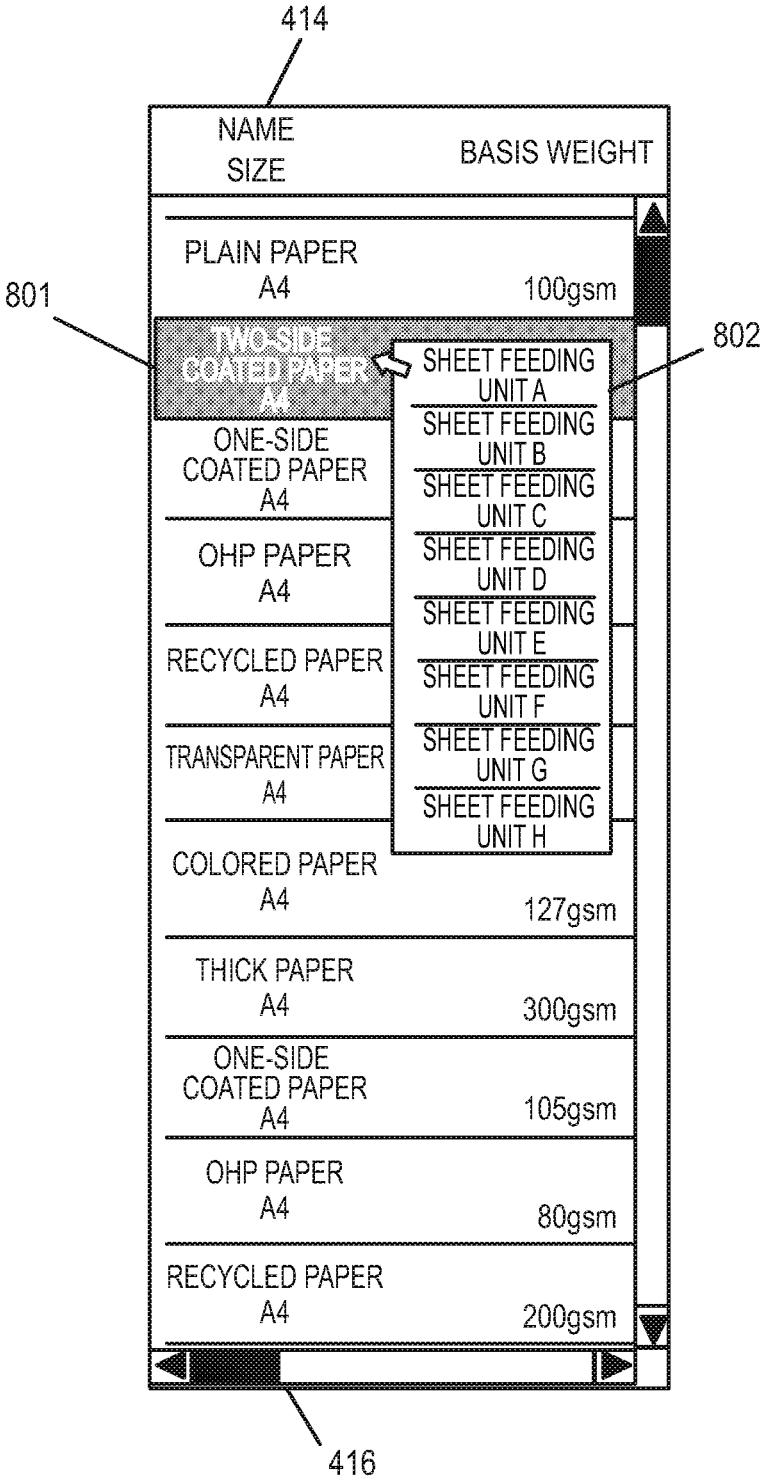
FIG. 8 is an example of display of a sheet list field.

FIG. 8 is a diagram for describing only the portion of the sheet list field 414 extracted from the screen displayed on the top screen 401 of the display device 113 of the print controlling apparatus 102 illustrated in FIGS. 4A and 4B.

A process to be performed when assigning a sheet of a desired attribute to the sheet feeding unit 116 will be described with reference to FIG. 8. Here, an example of assigning a two-side coated paper 801 shown on the sheet list field 414 to the sheet feeding unit 116 will be described.

FIG. 8 shows a state that the two-side coated paper 801 is selected by left-clicking the mouse 115 and then the list of one or more sheet feeding units to which the relevant sheet can be assigned is displayed as a context menu by right-clicking the mouse 115.

In order to decide the sheet feeding unit to which the two-side coated paper can be assigned, the information set in the parameters of each sheet of the sheet list information transmitted from the image forming apparatus 103 in S506 is used.

Then, when one sheet feeding unit (here, sheet feeding unit A) for which the setting of the two-side coated paper is desired is selected from a list of the sheet feeding units displayed in a context menu 802, the two-side coated paper is assigned to the designated sheet feeding unit 116*a*.

Next, a cooperative flow of the processes performed by the print controlling apparatus 102 illustrated in FIG. 5 and the process performed by the image forming apparatus 103 illustrated in FIG. 6 pill be described with reference to FIG. 9.

The program for performing the process performed in the print controlling apparatus 102 is stored in the external storage device 309 of the print controlling apparatus 102, read into the RAM 302, and executed by the CPU 301.

In this case, an example in which the operator assigns a sheet having a desired attribute (here, two-side coated paper) to a predetermined sheet feeding unit (here, sheet feeding unit 116*a*), supplies such a desired sheet to the assigned sheet feeding unit, and performs printing will be described.

First, in S901, the sheet management application and the image forming apparatus 103 perform the initializing process described in FIGS. 5 and 6.

Next, in S902, the operator instructs to display the sheet list field 414 on the top screen 401 of the sheet management application.

When the instruction to display the sheet list field 414 is made by the operator, the sheet management application creates the sheet list field 414 based on the information related to the attribute of the sheet created in S507.

Then, in S904, the sheet list field 414 created in S903 is displayed on the top screen 401.

Here, with reference to FIG. 8 as an example, an operation in which the operator selects the desired one sheet (two-side coated paper) from the sheet list field 414 and assigns the sheet of the selected attribute to the sheet feeding unit (sheet feeding unit 116*a*) will be described.

First, in S905, the operator selects the two-side coated paper 801 and right-clicks the mouse 115.

Then, in S906, the sheet management application creates the context menu 802 of the sheet feeding units by which the two-side coated paper 801 can be set.

Then, in S907, as illustrated in FIG. 8, the sheet management application displays the created context menu 802 on the sheet list field 414.

The information related to the designable sheet feeding units 116*a* to 116*h* is set as the parameters on each sheet of the information related to the attribute of the sheet obtained from the image forming apparatus 103 in S506. Therefore, in case of creating the context menu 802, the sheet management application uses the information related to the attributes of the sheets.

Next, in S908, the operator selects one sheet feeding unit (here, sheet feeding unit A) to which the sheet is assigned from the context menu 802.

Then, in S909, the sheet management application transmits an instruction to assign the selected two-side coated paper 801 to the sheet feeding unit A (sheet feeding unit 116*a*) to the image forming apparatus 103 via the control cable 108.

When the instruction to assign the sheet is received from the sheet management application via the LAN controller 206, in S910, the image forming apparatus 103 sets the two-side coated paper 801 to the designated sheet feeding unit (here, sheet feeding unit A).

In any case, the example wherein the sheet assignment is performed using the right-clicking has been described. However, as described above, the sheet may be assigned by selecting the two-side coated paper 801, dragging the mouse 115, and dropping the mouse on the sheet feeding unit button 406*a*.

In S911, the image forming apparatus 103 transmits a notification that the assignment of the sheet to the designated sheet feeding unit A (sheet feeding unit 116*a*) is successful to the sheet management application.

When the notification that the assignment of the sheet is successful is received, in S912, the sheet management application updates the information displayed on the sheet feeding unit button 406*a* of the sheet feeding unit A (sheet feeding unit 116*a*).

In S913, the sheet management application transmits an instruction for opening the sheet feeding unit A (sheet feeding unit 116*a*) to the image forming apparatus 103.

When the instruction for opening the sheet feeding unit A (sheet feeding unit 116*a*) is received, the image forming apparatus 103 opens the sheet feeding unit A (sheet feeding unit 116*a*) in S914.

In S915, the image forming apparatus 103 transmits to the sheet management application a notification that the sheet feeding unit A (sheet feeding unit 116*a*) is opened.

When the notification that the sheet feeding unit A (sheet feeding unit 116*a*) is opened is received, in S916, the sheet management application changes the open button 407*a* of the sheet feeding unit A (sheet feeding unit 116*a*) to an icon of an open state icon, thereby changing the state of the button to an un-depressible state.

Here, a flow of the processes of assigning the sheet to the sheet feeding unit, which is performed by the sheet management application, will be described with reference to a flowchart of FIG. 10.

When the operator selects and right-clicks one sheet having a desired attribute from the sheet list field 414, in S1001, the sheet management application creates the context menu 802 indicating the sheet feeding unit to which the relevant sheet can be assigned.

The information of the sheet feeding unit to which the sheet having the selected attribute is set as a parameter in the information related to the attribute of the sheet obtained from the image forming apparatus 103 in S506. Therefore, the sheet management application uses this information related to the attribute of the sheet when creating the context menu 802.

In S1002, when the sheet management application accepts the notification that the operator selects and designates one of the sheet feeding units from the list of the sheet feeding units that can be set, the process proceeds to S1003.

In S1003, the sheet management application transmits, to the image forming apparatus 103 via the control cable 108, an instruction to assign the sheet of the selected attribute to the designated sheet feeding unit.

In S1004, the sheet management application receives a reply (return) from the image forming apparatus 103 in response to the instruction to assign the sheet.

When the assignment of the sheet by the image forming apparatus 103 is successful, the process proceeds to S1005.

When the sheet assignment fails, the process in this flowchart ends.

When the assignment of the sheet is successful, in S1005, the sheet management application decides whether or not the sheet feeding unit to which the assignment of the sheet is designated has a function that can be remotely opened (remote opening function).

Here, since the sheet feeding unit open buttons 407*a* to 407*h* have been created respectively on the sheet feeding unit buttons 406*a* to 406*h*, the decision as to whether or not the sheet feeding units have the opening functions is performed based on the information of these buttons.

In S1005, when the sheet feeding unit to which the assignment of the sheet is designated is not the sheet feeding unit which can be opened remotely, the process in this flowchart ends.

On the other hand, in S1005, when the sheet feeding unit to which the assignment of the sheet is designated is the sheet feeding unit which can be opened remotely, the process proceeds to S1006.

In S1006, the sheet management application transmits an instruction for opening the designated sheet feeding unit to the image forming apparatus 103.

Figure 9:
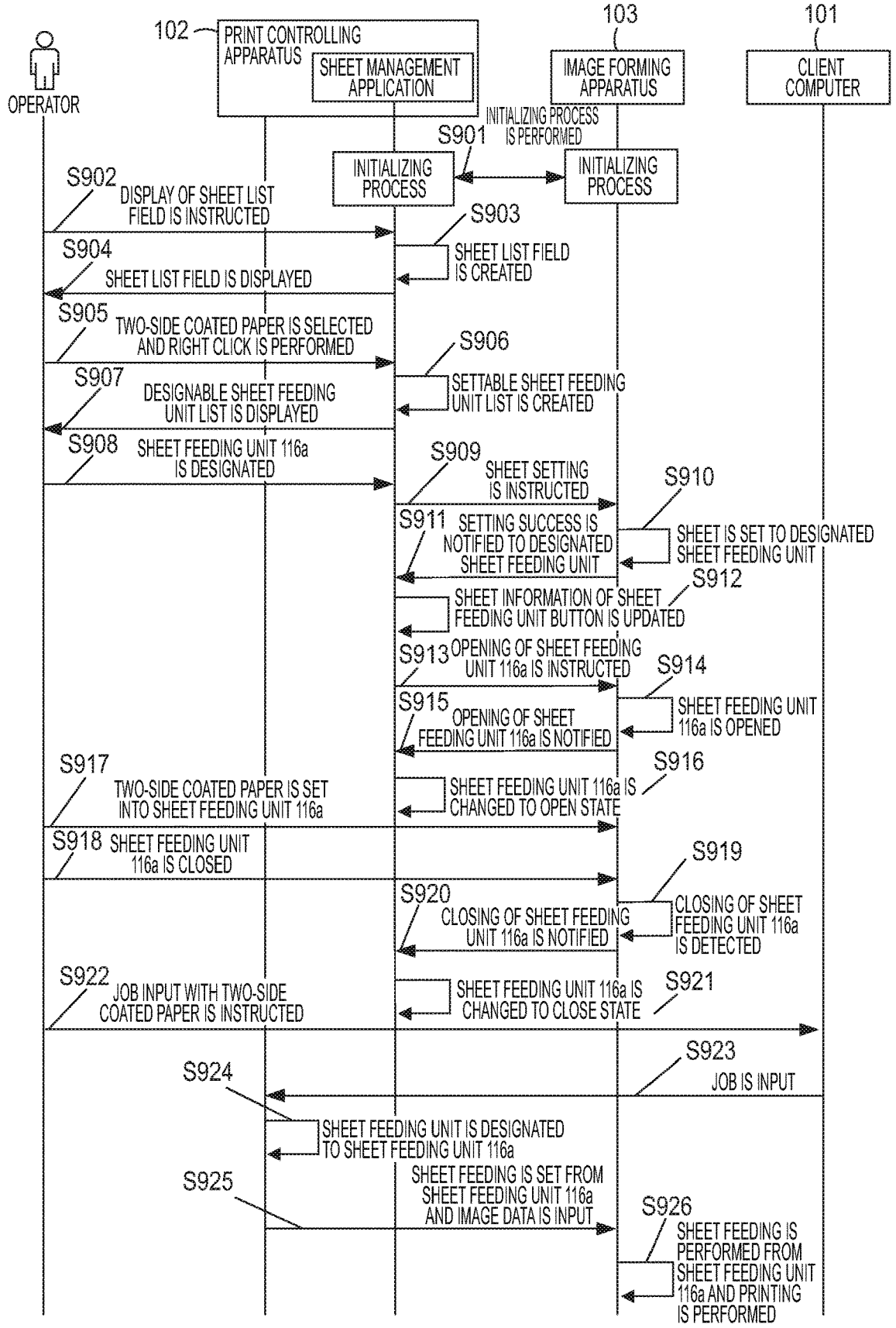
FIG. 9 is a flowchart for describing a cooperative flow of the processes to be performed by the print controlling apparatus and the image forming apparatus (Embodiment 1).

The explanation is returned to FIG. 9.

In S917, the operator sets a sheet bundle of the two-side coated paper to the sheet feeding unit A (sheet feeding unit 116*a*) opened in S916, from among the sheet feeding units 116*a* to 116*h* of the image forming apparatus 103.

Then, in S918, the operator closes the sheet feeding unit A (sheet feeding unit 116*a*).

When the operator closes the sheet feeding unit A (sheet feeding unit 116*a*), in S919, the image forming apparatus 103 detects the closing of the sheet feeding unit A (sheet feeding unit 116*a*).

In S920, the image forming apparatus 103 notifies the sheet management application of the closing of the sheet feeding unit A (sheet feeding unit 116*a*).

In S921, the sheet management application changes the open button 407*a* of the sheet feeding unit A (sheet feeding unit 116*a*) to a close state, thereby changing the state of the button to a depressible state.

Next, in S922, the operator selects the two-side coated paper from the client computer 101, and instructs to input a print job.

Then, in S923, the client computer 101 inputs the instructed print job to the print controlling apparatus 102.

In S924, the print controlling apparatus 102 designates the sheet feeding unit A (sheet feeding unit 116*a*) as the sheet feeding unit to be used.

In S925, the print controlling apparatus 102 transmits to the image forming apparatus 103 a notification that the sheet feeding unit A (sheet feeding unit 116*a*) is designated, and further transmits image data as print data.

Then, in S926, the image forming apparatus 103 feeds the two-side coated paper from the sheet feeding unit A (sheet feeding unit 116*a*), and prints the transmitted image data on the fed sheet.

Figure 11:
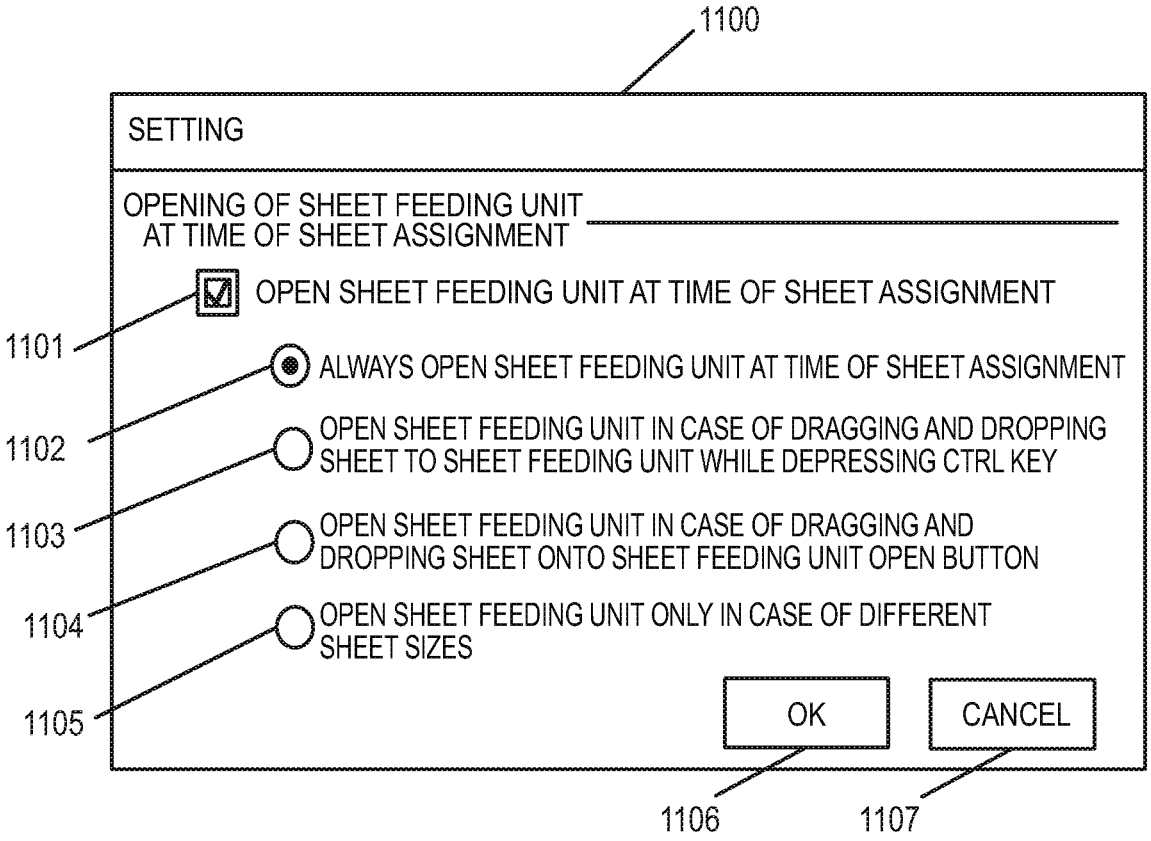
FIG. 11 is an example of a setting screen for setting a condition for opening the sheet feeding unit.

FIG. 11 is an example of a setting screen 1100 for setting a condition for opening the sheet feeding unit when the operator assigns the sheet to the sheet feeding unit. The setting screen 1100 is displayed by depressing the setting button 428 on the top screen 401 of the sheet management application. Incidentally, the setting screen described here is displayed on the display device 113 of the print controlling apparatus 102, or the like.

A check box 1101 is used by the operator to select whether or not to open the sheet feeding unit in case of assigning the sheet.

When the check box 1101 is not checked, the sheet feeding unit is not opened in case of assigning the sheet. That is, the sheet management application does not transmit the instruction for opening the sheet feeding unit in S913 of FIG. 9 to the image forming apparatus 103.

On the other hand, when the check box 1101 is checked, radio buttons 1102 to 1105 become available.

Then, when the operator selects any one of the radio buttons 1102 to 1105 and depresses an OK button 1106, the setting of the selected radio button is saved. Thus, as will be described later, the operator can set the condition for opening the sheet feeding unit in case of assigning the sheet.

When the operator selects one of the radio buttons 1102 to 1105 and sets the condition for opening the sheet feeding unit in case of assigning the sheet, the setting screen 1100 is closed.

When the operator depresses a cancel button 1107, the change on the screen is canceled, and the setting screen 1100 is closed.

In the case where the radio button 1102 is selected, when the sheet is assigned to the designated sheet feeding unit, the designated sheet feeding unit is necessarily opened. That is, when the sheet is assigned, the above-described open instruction (S913) of the sheet feeding unit of FIG. 9 is necessarily transmitted to the image forming apparatus 103.

In the case where the radio button 1103 is selected, in the sheet list field 414, only when the operator drags and drops the sheet onto one of the sheet feeding unit buttons 406*a* to 406*h* while depressing the control key of the keyboard 114, the corresponding sheet feeding unit is opened.

Incidentally, the control key is an example here, and another key may be assigned to this operation.

In the case where the radio button 1104 is selected, when the operator drops the sheet dragged in the sheet list field 414 onto the sheet feeding unit open buttons 407*a* to 407*h* arranged on the sheet feeding unit buttons 406*a* to 406*h*, the corresponding sheet feeding unit is opened.

That is, if the operator drops the sheet dragged in an area other than the sheet feeding unit open buttons 407*a* to 407*h* within the area of the sheet feeding unit buttons 406*a* to 406*h*, the sheet feeding unit is not opened, and only the assignment of the sheet to the sheet feeding unit is performed.

In the case where the radio button 1105 is selected, the sheet feeding unit is opened only when the size of the sheet held in the sheet feeding unit is different from the size of the sheet to be just assigned. This is because, when the sheet having a different size is assigned, it may be necessary to replace the sheets without fail.

As a case where it is not necessary to open the sheet feeding unit when assigning the sheet, for example, there is a case where a plurality of kinds (sheets) adjusted for respective seasons with respect to one sheet are registered respectively with different names and these kinds (sheets) are used properly for respective seasons. More specifically, there is adjustment of a secondary transfer voltage of the image forming apparatus 103, which is one of various parameters displayed on the adjustment buttons 417 of FIG. 4B.

The adjustment of the secondary transfer voltage is a parameter for changing the voltage at the time of transferring a toner image onto the sheet, and this parameter depends largely on environments (humidity, temperature) in which the image forming apparatus 103 is used. Thus, for example, there is a case where adjustment values of the secondary transfer voltage are registered as four kinds of sheets changed for respective seasons, and used properly according to the season. In the case like this, it is unnecessary to replace the sheet itself held in the sheet feeding unit, and it only has to change the adjustment value of the parameter.

In such case of assigning the sheets of which only the adjustment values are different from others, an item for controlling so as not to open the sheet feeding unit be prepared.

Embodiment 2

In the Embodiment 1, the sheet of the desired attribute is assigned to the sheet feeding unit designated by the operator, and at the same time, the sheet feeding unit of the print controlling apparatus 102 is set to be opened. Thus, the Embodiment 1 works towards being able to prevent the operator from erroneously feeding the sheet to the sheet feeding unit, and to correctly and/or appropriately feed the sheet of the attribute coincident with the attribute of the sheet set in the sheet feeding unit to the relevant sheet feeding unit.

On another front, in the Embodiment 2, in order to cope with a case where the operator does not wish to open the sheet feeding unit or in order to prevent that the operator performs an erroneous operation, it is set to provide delay from the time when the operator assigns the sheet to the time when the sheet feeding unit is opened. Thus, it becomes possible for the operator to cancel an opening process of opening the sheet feeding unit, if necessary.

Incidentally, the overall configuration of the printing system 100, the hardware constitution of the print controlling apparatus 102, the hardware constitution of the image forming apparatus 103, and the like are the same as those in the Embodiment 1.

In the Embodiment 2, a cooperative flow of the processes to be performed by the print controlling apparatus 102 and the image forming apparatus 103 will be described with reference to FIG. 12.

The program to be executed on the print controlling apparatus 102 is stored in the external storage device 309 of the print controlling apparatus 102, read into the RAM 302, and executed by the CPU 301.

Figure 12:
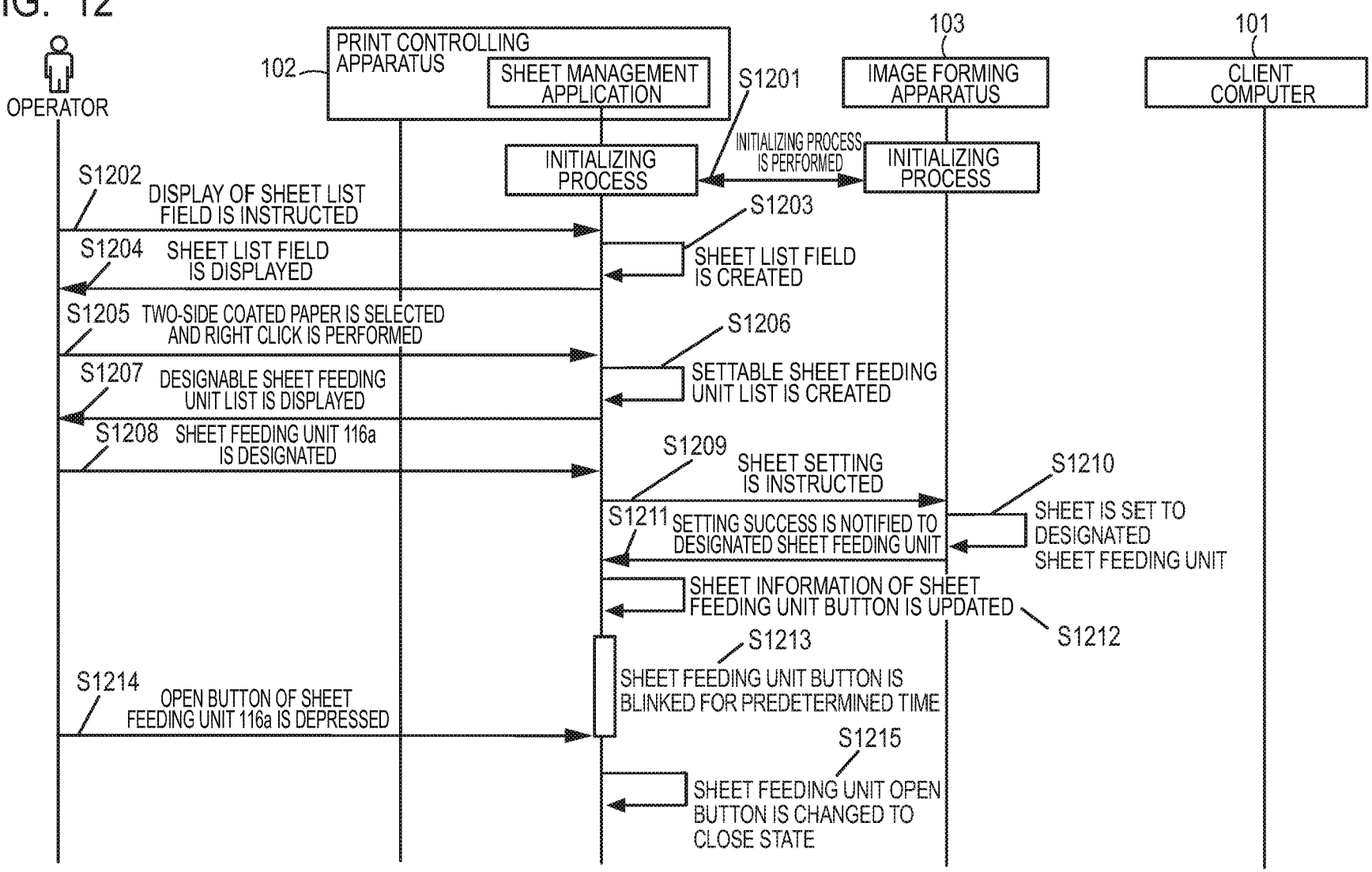
FIG. 12 is a flowchart for describing a cooperative flow of the processes to be performed by the print controlling apparatus and the image forming apparatus (Embodiment 2).

FIG. 12 is the flowchart for describing a process of canceling the opening process of the sheet feeding unit after the operator assigned the desired-attribute sheet to the designated sheet feeding unit and before the sheet feeding unit is actually opened.

As well as the Embodiment 1, the example in which the two-side coated paper 801 is assigned to the sheet feeding unit A (sheet feeding unit 116*a*) will be described here.

Incidentally, since S1201 to S1212 are the steps same as those of S901 to S912 of FIG. 9 in the Embodiment 1, the descriptions thereof will be omitted.

In S1213, the sheet management application blinks the open button 407*a* of the sheet feeding unit 116*a* for a set period of time, before transmitting the instruction for opening the sheet feeding unit 116*a* to the image forming apparatus 103.

For example, the blinking is expressed by changing the color of a sheet feeding unit open icon from gray to black at certain time intervals.

In S1214, while the sheet feeding unit open button 407*a* is blinking, the operator depresses the sheet feeding unit open button 407*a*.

When the sheet feeding unit open button 407*a* is depressed while the blinking, the sheet management application cancels the opening process of the sheet feeding unit 116*a*. That is, the sheet management application does not transmit the instruction for opening the sheet feeding unit 116*a* to the image forming apparatus 103.

Then, in S1215, the sheet management application changes the sheet feeding unit open button 407*a* to a close state.

When the operator does not depress the sheet feeding unit open button 407*a* while the sheet feeding unit open button 407*a* is blinking, after the set period of time elapsed, the sheet feeding unit 116*a* is opened after the end of the blinking of the sheet feeding unit open button 407*a*.

Figure 13:
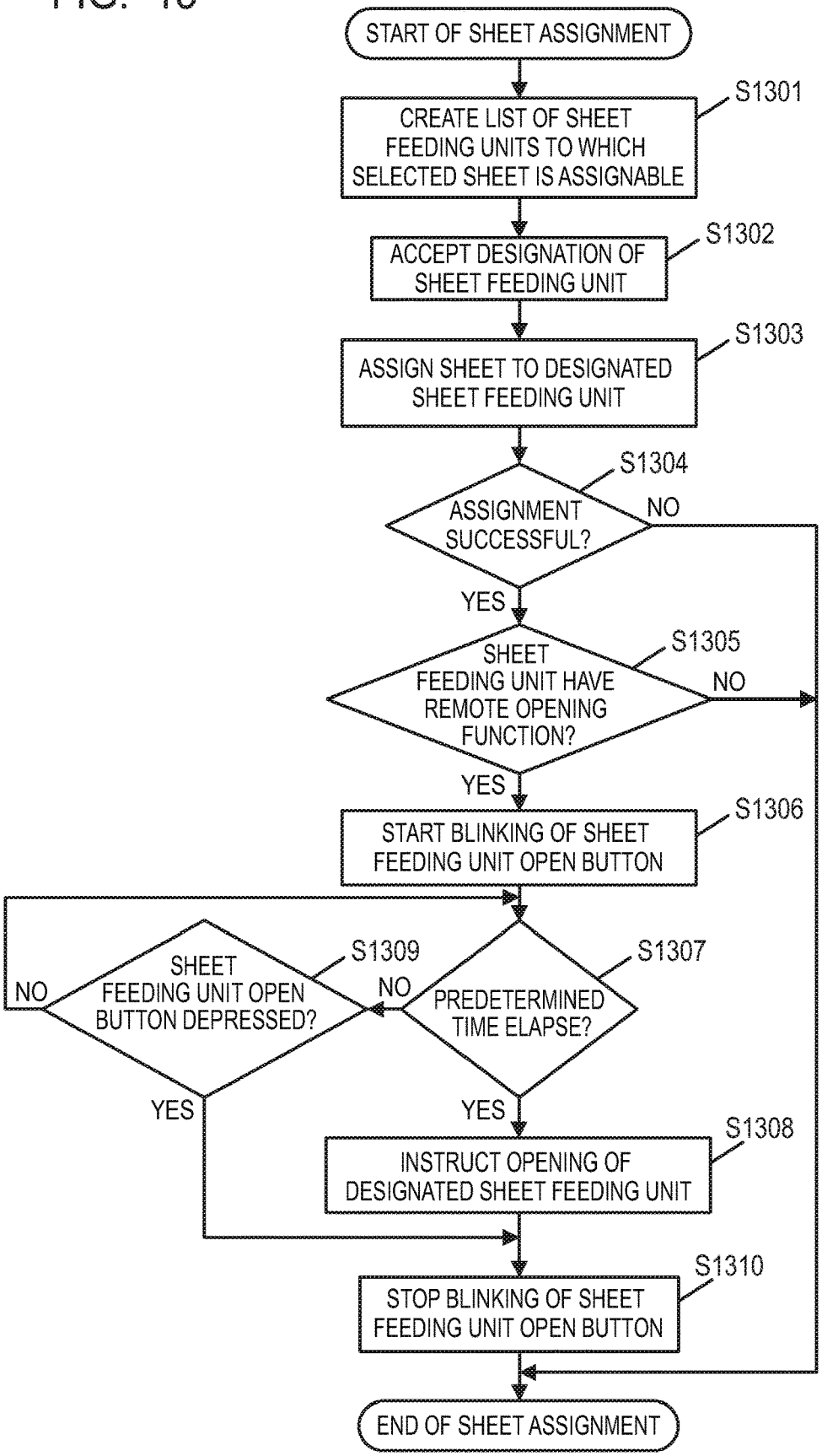
FIG. 13 is a flowchart for describing a process of assigning a sheet to the sheet feeding unit (Embodiment 2).

FIG. 13 is a flowchart for describing a flow of processes to be performed by the sheet management application, for assigning the sheet to the sheet feeding unit in the Embodiment 2.

Figure 10:
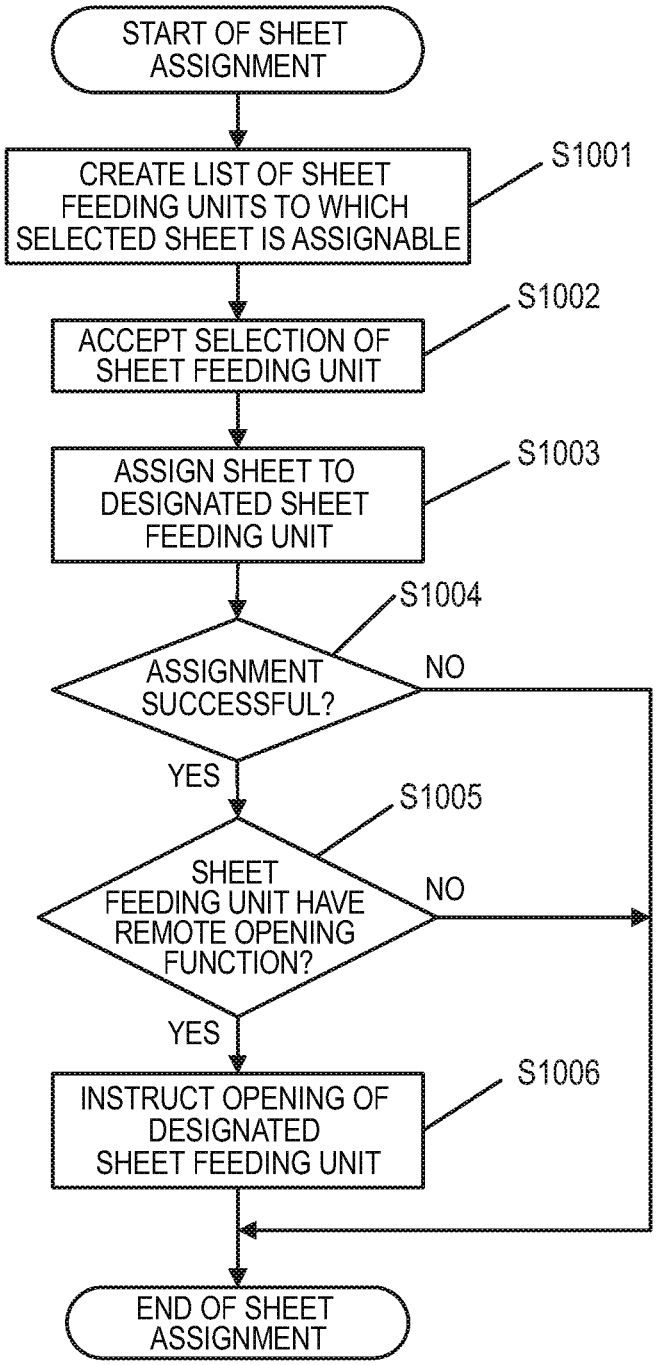
FIG. 10 is a flowchart for describing a process of assigning a sheet to the sheet feeding unit (Embodiment 1).

Incidentally, since S1301 to S1305 are the steps same as those of S1001 to S1005 of FIG. 10 in the Embodiment 1, the descriptions thereof will be omitted.

In S1306, the sheet management application starts the blinking of the sheet feeding unit open button 407*a*.

Next, in S1307, the sheet management application checks whether or not a predetermined time set in later-described FIG. 14 elapses.

When the predetermined time elapses, in S1308, the sheet management application transmits an instruction for opening the sheet feeding unit 116*a* to the image forming apparatus 103.

When the predetermined time does not elapse in S1307, in S1309, the sheet management application checks whether or not the sheet feeding unit open button 407*a* is depressed.

When the button is not depressed, the process returns to S1307.

On the other hand, when the sheet feeding unit open button 407*a* is depressed in S1309, the sheet management application considers that the operator has instructed to cancel opening the sheet feeding unit 116*a*.

Then, in S1310, the sheet management application stops blinking the sheet feeding unit open button 407*a*, and the process in this flowchart ends.

As just described, by depressing the sheet feeding unit open button while the sheet feeding unit open button is blinking, it is possible for the operator to cancel the opening of the sheet feeding unit.

Figure 14:
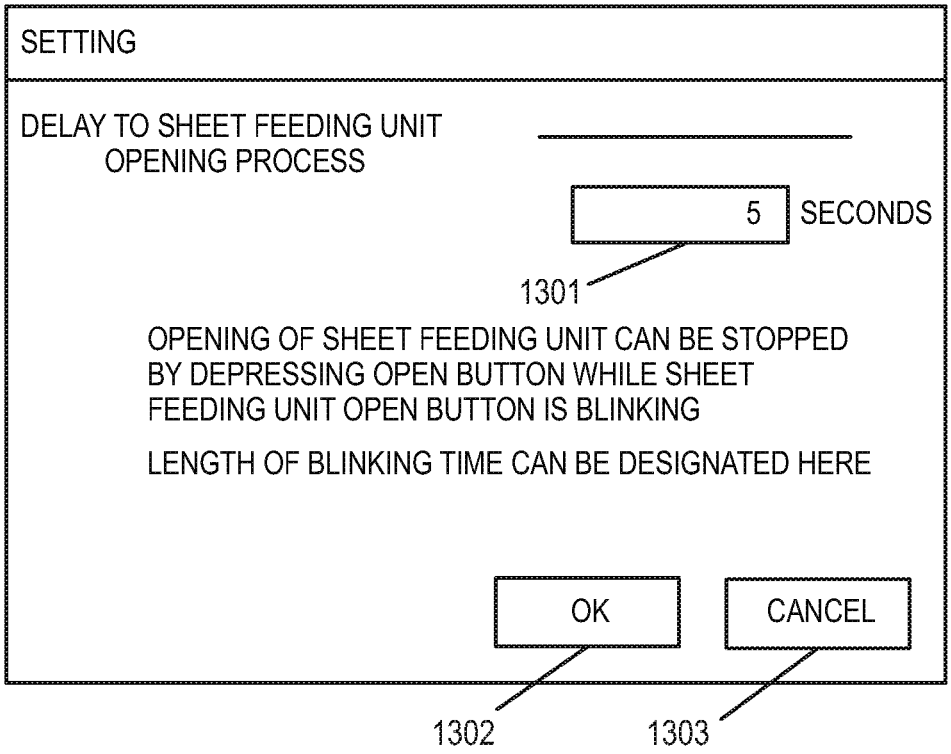
FIG. 14 is an example of a setting screen for assigning the sheet to the sheet feeding unit.

FIG. 14 is a diagram for describing an example of a setting screen on which the time for blinking the sheet feeding unit can be set when assigning the sheet.

After assigning the sheet of the desired attribute to the desired sheet feeding unit, when the time set on the setting screen elapses, the opening of the sheet feeding unit is performed. FIG. 14 shows the example in which "5" seconds is set as a setting time 1301. When an OK button 1302 is depressed, the set time is stored and the setting screen is closed. When a cancel button 1303 is depressed, the change on the setting screen is canceled and the setting screen is closed. Incidentally, the setting screen described here is displayed on the display device 113 of the print controlling apparatus 102, or the like.

According to one of aspects of present embodiments, it is possible to securely feeding a sheet matching an attribute of sheet set in a sheet feeding unit of an image forming apparatus to the sheet feeding deck, thereby improving and/or refining operability of an operator. When an operator assigns desired sheet information to a designated sheet feeding unit, the sheet feeding unit is physically opened. Thus, it is possible to provide a system which prevents the operator from erroneously feeding a sheet to the sheet feeding unit and surely feeds a sheet coinciding with the sheet information set in the sheet feeding unit according to one of aspects of present embodiments.

Other Embodiments

The present disclosure can be realized also by a process in which a program for realizing one of more functions of the above embodiments is supplied to a system or an apparatus via a network or a storage medium and one or more processors in the system or the apparatus read and execute the supplied program. Besides, the present disclosure can be realized also by a circuit (e.g., ASIC) of realizing one or more functions of the above embodiments.

Besides, the present disclosure may be applied to a system consisting of a plurality of devices, or to an apparatus having a single device.

The present disclosure is not limited to the above embodiments, various modifications (including organic combinations of the respective embodiments) are possible based on the spirit of the present disclosure, and these modifications should not be excluded from the scope of the present disclosure. That is, all combinations of the above embodiments and modifications thereof are also included in the present disclosure.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-083578, filed Apr. 25, 2018, which is hereby incorporated by reference herein in its entirety.

What is claimed is:

1. A control apparatus which is able to communicate with an image forming apparatus configured to form an image on a sheet conveyed from a sheet holding unit that is able to be opened and closed, the control apparatus comprising:

a user interface configured to receive an assigning instruction for assigning sheet information to the sheet holding unit; and a controller configured to cause the sheet holding unit to be opened, wherein the controller causes the sheet holding unit to be opened based on elapse of a certain period of time after the user interface receives the assigning instruction, and wherein, based on the user interface receiving, during the certain period of time, a cancelling instruction for cancelling opening of the sheet holding unit, the controller does not cause the sheet holding unit to be opened.

2. The control apparatus according to claim 1, wherein the certain period of time is set by the user interface before the user interface receives the assigning instruction.

3. The control apparatus according to claim 1, wherein the controller is configured to determine whether the sheet holding unit is able to be opened by a remote instruction, and wherein, in a case where the controller determines that the sheet holding unit is able to be opened by the remote instruction, the controller causes the sheet holding unit to be opened based on elapse of the certain period of time after the user interface receives the assigning instruction.

4. The control apparatus according to claim 1, wherein the image forming apparatus has a plurality of sheet holding units, wherein the user interface is configured to select a sheet holding unit from among the plurality of sheet holding units, and wherein the user interface is configured to receive the assigning instruction for the sheet holding unit selected by the user interface.

5. The control apparatus according to claim 1, further comprising a display configured to display an object for receiving the assigning instruction, and to cause the object to be blinked during the certain period of time.

6. The control apparatus according to claim 1, wherein the sheet information to be assigned based on the received assigning instruction is a type of sheet.

7. An image forming system configured to form an image on a sheet conveyed from a sheet holding unit that is able to be opened and closed, the image forming system comprising:

a user interface configured to receive an assigning instruction for assigning sheet information to the sheet holding unit; and a controller configured to cause the sheet holding unit to be opened, wherein the controller causes the sheet holding unit to be opened based on elapse of a certain period of time after the user interface receives the assigning instruction, and wherein, based on the user interface receiving, during the certain period of time, a cancelling instruction for cancelling opening of the sheet holding unit, the controller does not cause the sheet holding unit to be opened.

8. A controller method for a control apparatus having a user interface and a controller and which is able to communicate with an image forming apparatus configured to form an image on a sheet conveyed from a sheet holding unit that is able to be opened and closed, the controller method comprising:

receiving, via the user interface, an assigning instruction for assigning sheet information to the sheet holding unit; and causing, via the controller, the sheet holding unit to be opened based on elapse of a certain period of time after the user interface receives the assigning instruction, wherein, based on the user interface receiving, during the certain period of time, a cancelling instruction for cancelling opening of the sheet holding unit, the controller does not cause the sheet holding unit to be opened.

* * * * *